US011164559B2

(12) United States Patent
Lee et al.

(10) Patent No.: US 11,164,559 B2
(45) Date of Patent: Nov. 2, 2021

(54) SELECTIVE SOUND TRANSMISSION AND ACTIVE SOUND TRANSMISSION CONTROL

(71) Applicant: Toyota Motor Engineering & Manufacturing North America, Inc., Plano, TX (US)

(72) Inventors: Taehwa Lee, Ann Arbor, MI (US); Hideo Iizuka, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 560 days.

(21) Appl. No.: 15/966,325

(22) Filed: Apr. 30, 2018

(65) Prior Publication Data

US 2019/0333495 A1 Oct. 31, 2019

(51) Int. Cl.
*G10K 11/20* (2006.01)
*G10K 11/172* (2006.01)
(Continued)

(52) U.S. Cl.
CPC ..... *G10K 11/20* (2013.01); *G10K 11/162* (2013.01); *G10K 11/172* (2013.01); *G10K 11/22* (2013.01); *G10K 11/34* (2013.01)

(58) Field of Classification Search
CPC .... G10K 11/162; G10K 11/172; G10K 11/22; G10K 11/20; G10K 11/34; G10K 11/16
(Continued)

(56) References Cited

U.S. PATENT DOCUMENTS 4,399,334 A * 8/1983 Kakiuchi ..... H04R 1/1008 181/157
5,416,751 A * 5/1995 Imahori ..... G10K 9/18 367/175

(Continued)

FOREIGN PATENT DOCUMENTS

DE 102015103936 A1 9/2016
WO 2017103172 A1 6/2017

OTHER PUBLICATIONS

Lani, S., "Ultrasonic Subwavelength Acoustic Focusing and Imaging Using a 2D Membrane Metamaterial," Ph.D. Thesis, Georgia Inst. Tech. (2015).

(Continued)

*Primary Examiner* — Forrest M Phillips
(74) *Attorney, Agent, or Firm* — Christopher G. Darrow; Darrow Mustafa PC

(57) ABSTRACT

Passively controlled acoustic metamaterials allow transmission of low amplitude acoustic (sound) waves having a resonance frequency and reflect waves having a substantially different frequency. Such materials also reflect waves having the resonance frequency when those waves have an amplitude exceeding a threshold. High amplitude resonance waves cause a resonance membrane contained in unit cells of the metamaterial to contact a rigid structure that is positioned at a longitudinal constraint distance from the resonance membrane in each unit cell. Such contact changes the resonance frequency of the membrane, thereby causing reflection of high amplitude waves. Actively controlled acoustic metamaterials include a ferromagnetic layer on the membrane and an electromagnetic positioned in each unit cell. Activation of the electromagnetic displaces the membrane and thereby shifts the resonance frequency of the membrane, on demand.

18 Claims, 5 Drawing Sheets

(51) Int. Cl.
*G10K 11/34* (2006.01)
*G10K 11/22* (2006.01)
*G10K 11/162* (2006.01)

(58) Field of Classification Search
USPC ..... 181/175, 166, 167
See application file for complete search history.

(56) References Cited

U.S. PATENT DOCUMENTS 8,616,330 B1 * 12/2013 McKnight ..... G10K 11/16 181/207
8,857,563 B1 * 10/2014 Chang ..... H03H 9/25 181/286
8,885,868 B2 * 11/2014 Davidson ..... H04R 7/18 381/404
9,076,429 B2 * 7/2015 Islam ..... G10K 11/172
9,659,557 B2 * 5/2017 Yang ..... G10K 11/172
10,043,508 B2 * 8/2018 Park ..... G10K 11/02
2013/0087407 A1 * 4/2013 McKnight ..... G10K 11/172 181/287
2014/0116802 A1 * 5/2014 Ma ..... G10K 11/18 181/286
2016/0104472 A1 * 4/2016 Sheng ..... G10K 11/172 181/288
2017/0268591 A1 * 9/2017 Harne ..... F16F 1/3605
2019/0333491 A1 * 10/2019 Lee ..... G10K 11/162
2020/0202831 A1 * 6/2020 Lee ..... G10K 11/162

OTHER PUBLICATIONS

Xiao, S. et al., "Active control of membrane-type acoustic metamaterial by electric field," Applied Physics Letters 106, 091904 pp. 1-4 (2015).
Wakatsuchi, H. et al., "Waveform-Dependent Absorbing Metasurfaces," PRL 111, 245501 pp. 1-5 (2013).

* cited by examiner

SELECTIVE SOUND TRANSMISSION AND ACTIVE SOUND TRANSMISSION CONTROL

TECHNICAL FIELD

The present disclosure generally relates to acoustic metamaterials and, more particularly, to structures having passive and active measures for selectively reflecting sound.

BACKGROUND

The background description provided herein is for the purpose of generally presenting the context of the disclosure. Work of the presently named inventors, to the extent it may be described in this background section, as well as aspects of the description that may not otherwise qualify as prior art at the time of filing, are neither expressly nor impliedly admitted as prior art against the present technology.

Membrane resonators can be used to selectively transmit sound waves having a frequency that resonates with a membrane in the resonator. Electrostatic forces can be used in combination with electrodes positioned on the resonant membrane to displace the membrane and/or modify membrane tension, thereby modulating the resonant frequency of the membrane and changing the transmission/reflection properties of the resonator.

It would be desirable to provide a passive control system, requiring no input, and enabling a metamaterial composed of membrane resonators to specifically reflect high amplitude acoustic waves. It would additionally be desirable to provide a simple and highly effective mechanism for active control of such a metamaterial.

SUMMARY

This section provides a general summary of the disclosure, and is not a comprehensive disclosure of its full scope or all of its features.

In various aspects, the present teachings provide an acoustic metamaterial having passive transmission control, the metamaterial having a periodic array of unit cells. Each unit cell includes a transmissive acoustic channel, having a structure with at least one side wall and two open ends to allow for passage of acoustic waves in a longitudinal direction. Each unit cell further includes a resonance membrane positioned laterally across the transmissive acoustic channel, and configured to vibrate at an intrinsic resonance frequency, in response to an incident acoustic wave component having the intrinsic resonance frequency, thereby transmitting the wave component. Each unit cell also includes at least one rigid structure positioned within the transmissive acoustic channel, occupying a planar space parallel to, and separated by a constraint distance from, the resonance membrane. A vibrational amplitude of the resonance membrane that exceeds the constraint distance causes the resonance membrane to contact the at least one rigid structure, thereby decreasing transmission of the wave component.

In other aspects, the present teachings provide an acoustic metamaterial having active transmission control, the metamaterial having a periodic array of unit cells. Each unit cell includes a transmissive acoustic channel, having a structure with at least one side wall and two open ends to allow for passage of acoustic waves in a longitudinal direction. Each unit cell further includes a resonance membrane positioned laterally across the transmissive acoustic channel, and configured to vibrate at an intrinsic resonance frequency, in response to an incident acoustic wave component having the intrinsic resonance frequency, thereby transmitting the wave component. Each unit cell also includes a ferromagnetic material affixed to a portion of a surface of the resonance membrane. Each unit cell further includes an electromagnet positioned a longitudinal distance from the resonance membrane and, in conjunction with the ferromagnetic layer, configured to bias the resonance membrane, thereby changing its inherent resonance frequency.

In still other aspects, the present teachings provide system for toggling transmission of acoustic waves having a selected frequency. The system includes an acoustic metamaterial having active transmission control, the metamaterial having a periodic array of unit cells. Each unit cell includes a transmissive acoustic channel, having a structure with at least one side wall and two open ends to allow for passage of acoustic waves in a longitudinal direction. Each unit cell further includes a resonance membrane positioned laterally across the transmissive acoustic channel, and configured to vibrate at an intrinsic resonance frequency, in response to an incident acoustic wave component having the intrinsic resonance frequency, thereby transmitting the wave component. Each unit cell also includes a ferromagnetic material affixed to a portion of a surface of the resonance membrane. Each unit cell further includes an electromagnet positioned a longitudinal distance from the resonance membrane and, in conjunction with the ferromagnetic layer, configured to bias the resonance membrane, thereby changing its inherent resonance frequency. The system also includes a controller configured to reversibly supply current to the electromagnets, thereby reversibly switching the acoustic metamaterial from a transmission state in which it substantially transmits acoustic waves having the selected frequency to a reflection state in which it substantially reflect acoustic waves having the selected frequency. The system further includes an input device configured to provide a signal directing the controller to switch the acoustic metamaterial from the transmission state to the reflection state.

Further areas of applicability and various methods of enhancing the disclosed technology will become apparent from the description provided herein. The description and specific examples in this summary are intended for purposes of illustration only and are not intended to limit the scope of the present disclosure.

BRIEF DESCRIPTION OF THE DRAWINGS

The present teachings will become more fully understood from the detailed description and the accompanying drawings, wherein.

It should be noted that the figures set forth herein are intended to exemplify the general characteristics of the methods, algorithms, and devices among those of the present technology, for the purpose of the description of certain aspects. These figures may not precisely reflect the characteristics of any given aspect, and are not necessarily intended to define or limit specific embodiments within the scope of this technology. Further, certain aspects may incorporate features from a combination of figures.

DETAILED DESCRIPTION

The present teachings provide membrane-type acoustic metamaterials that include passive controls to selectively reflect high pressure acoustic waves and/or active controls to selectively reflect waves of a particular frequency.

The metamaterials of the present teachings include an array of unit cells, each having a transmissive acoustic channel including a resonant membrane positioned within. The membrane is configured to allow transmission of acoustic waves within a frequency range that corresponds to a resonant frequency of the membrane. The metamaterials can further include a rigid structure positioned adjacent to the resonant membrane that, under a control condition, will contact the resonant membrane causing it to reflect acoustic waves within the aforementioned frequency range. In passive control systems, such contact is dependent upon the amplitude of the incoming waves. In active control systems, such contact can be user selected by activation of an electromagnet or other device.

Figure 1A:
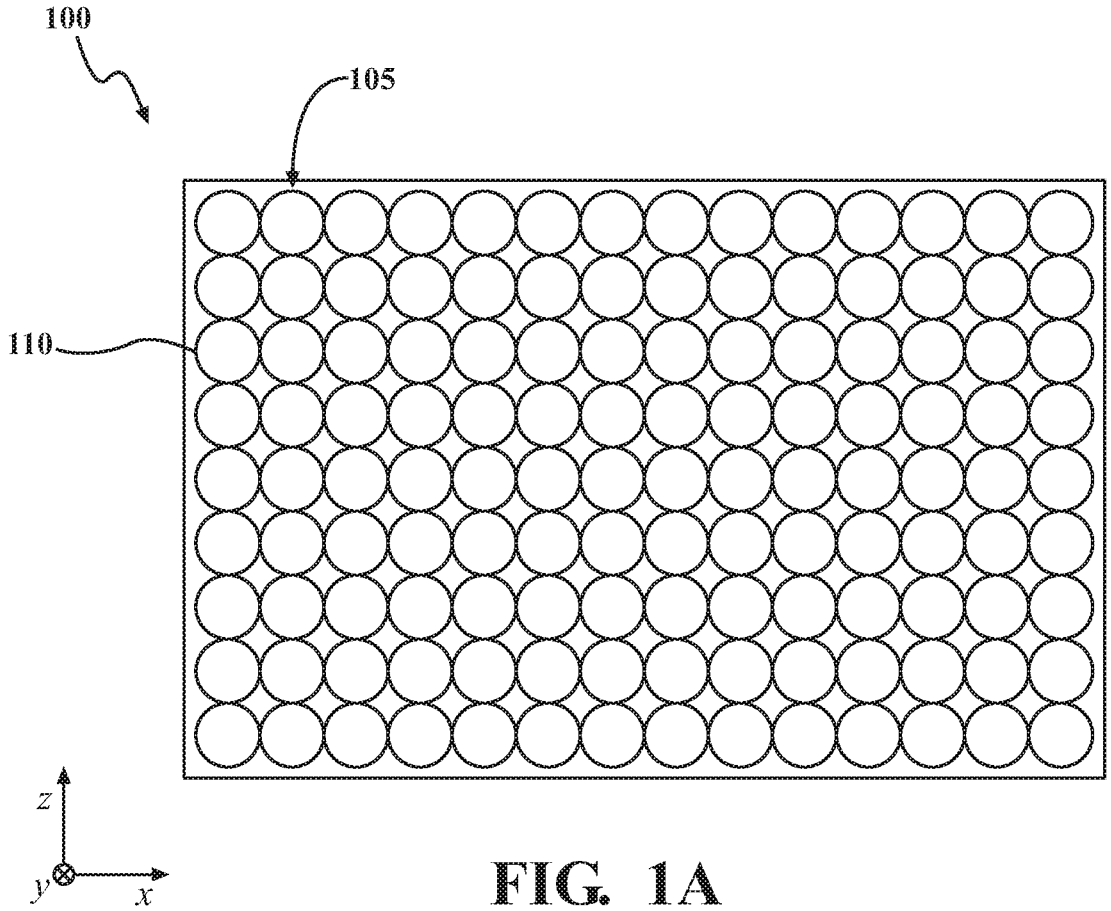
FIG. 1A is a top plan view of an acoustic metamaterial of the present teachings.
Figure 1B:
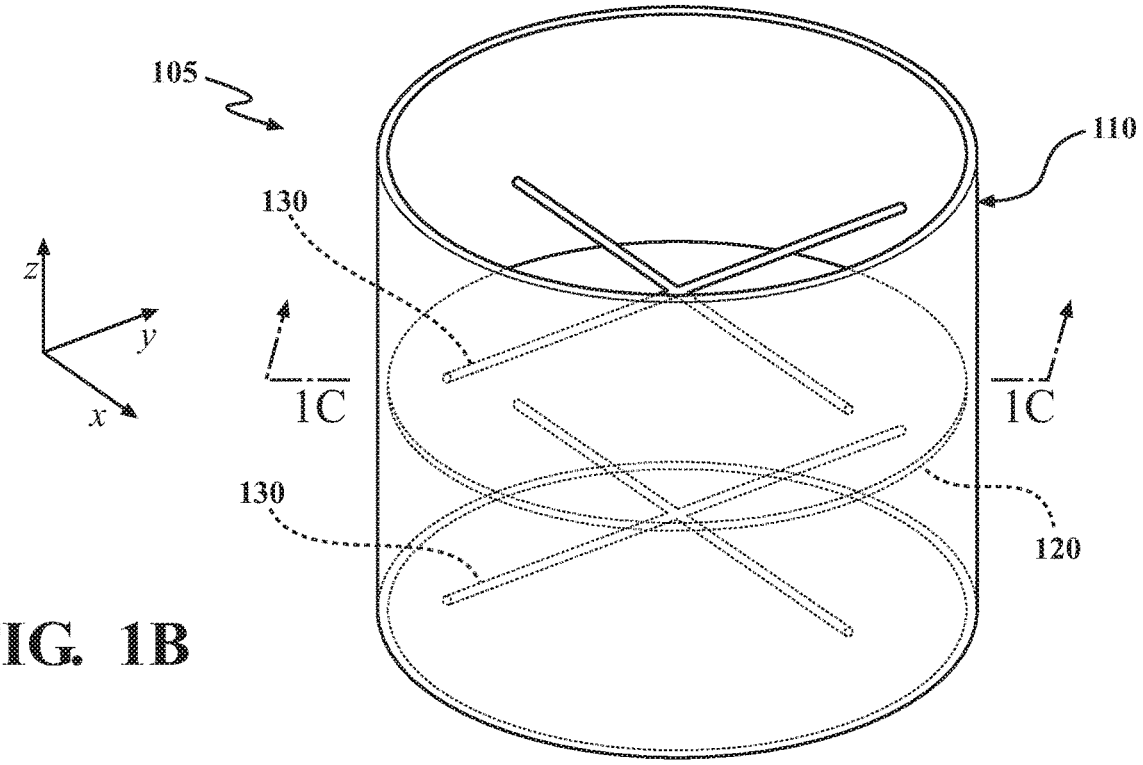
FIG. 1B is a perspective view of a unit cell of the acoustic metamaterial of FIG. 1A.
Figure 1C:
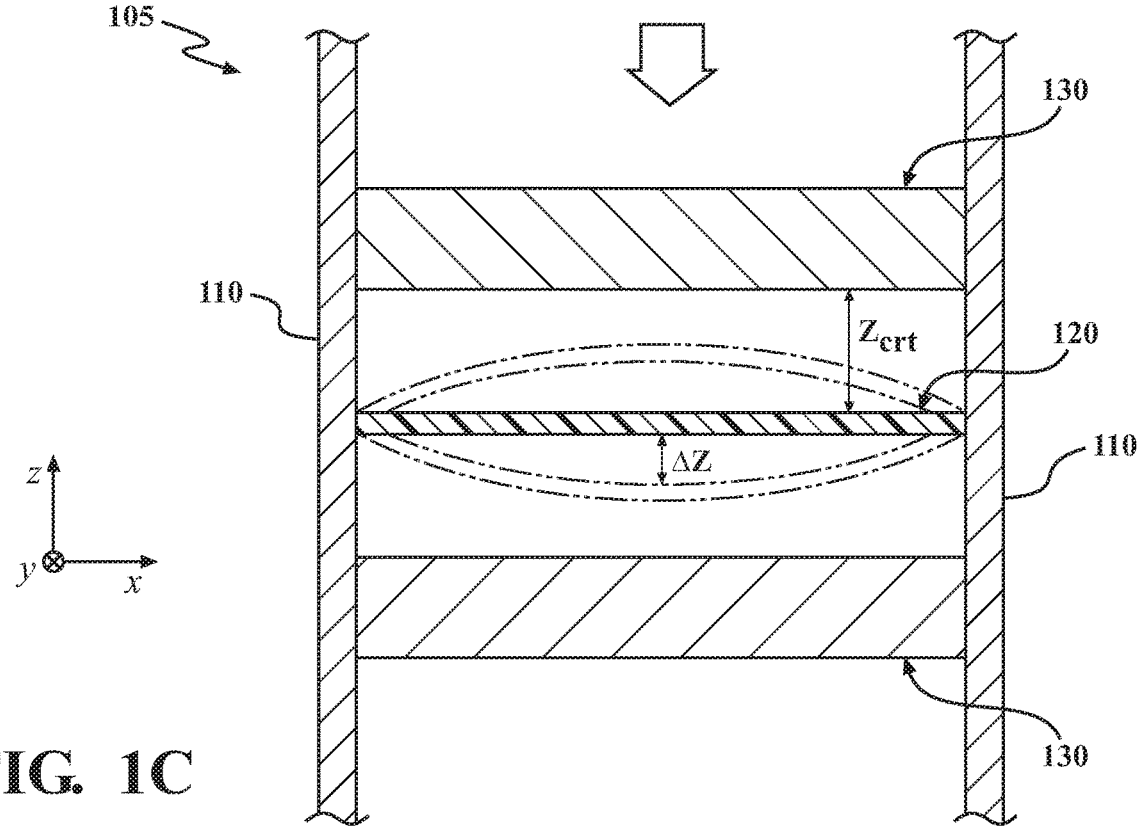
FIG. 1C is a side cross-sectional view of the unit cell of FIG. 1B, viewed along the line 1C-1C.

FIG. 1A shows a top plan view of a portion of a disclosed acoustic metamaterial 100 having an array of unit cells 105. FIG. 1B shows a perspective view of a single unit cell 105. Each unit cell 105 includes a transmissive acoustic channel 110, having a structure with at least one side wall and two open ends to allow for passage of acoustic waves in a longitudinal direction, corresponding to the z-dimension of FIG. 1B. In general, the term "longitudinal" as used herein refers to the z-dimension as shown in FIGS. 1A-1C, and the term "lateral" refers to either or both of the x and y-dimensions. While the exemplary transmissive acoustic channel 110 of FIG. 1B is an open-ended cylinder, having a circular cross-sectional shape that is observable from the top plan view of FIG. 1A, it could equally be a rectangular prism having a rectangular cross-sectional shape, a triangular prism having a triangular cross-sectional shape, or other structure.

The transmissive acoustic channel 110 can be formed of a solid, sound reflecting material. In general, the material or materials of which the transmissive acoustic channel 110 are formed will have acoustic impedance substantially higher than that of air, or other acoustic medium in which the metamaterial is deployed. Such materials can include a thermoplastic resin, such as polyurethane, a ceramic, a metal, or any other suitable material. In various implementations, the transmissive acoustic channel 110 can have maximum longitudinal and/or lateral dimensions within a range of from about several hundred μm to several millimeters.

It will be understood by those with knowledge of the art that an acoustic wave can be physically characterized as regions of alternating high pressure and low pressure, traveling through a medium, such as air. As such, an acoustic wave possesses, among other properties, frequency and amplitude. Frequency roughly corresponds to the rate at which succeeding, equivalent pressure regions (e.g. pressure maxima) arrive at a given point, and that a given acoustic wave can include a combination of multiple different frequencies, such as can be deconvoluted via Fourier Transform. It will also be understood that amplitude corresponds to the pressure differential between pressure maxima and minima, and that multiple frequency components of a complex wave can each have their own amplitude.

It will further be understood that a membrane, a thin layer of elastic or semi-elastic material positioned across a space with tension, can in certain situations vibrate if an acoustic wave is incident upon it. Such a membrane intrinsically has one or more vibrational modes with a specific frequency. When an incident acoustic wave possesses a frequency component that is near or equivalent to the intrinsic vibrational frequency of the membrane (the resonance frequency), the membrane will vibrate, at this frequency, with an amplitude proportional to the amplitude of the resonance frequency component. Thus, the term "pressure differential" is generally used below to refer to the amplitude of an acoustic wave propagating through a medium, and "amplitude" is generally used to refer to the magnitude of vibrations of a membrane upon which such a wave is incident. In addition, while portions of the present teachings discuss the responses of disclosed metamaterials to simple waves, having a single frequency and pressure differential, such discussions are equally applicable to complex having multiple frequencies and amplitudes.

It will be understood that a resonance membrane 120 can have multiple vibrational modes with different intrinsic resonance frequencies (e.g. $F_{R1'}$, $F_{R1''}$, etc.). The passive and active control systems described below for selective transmission and reflection of acoustic waves will, in many instances, be effective to selectively transmit/reflect frequencies associated with multiple vibrational modes, due to the strong physical constraint placed on the resonance membrane 120 when in a "reflection state". The physical constraints employed in the passive and active control systems are described below.

FIG. 1C shows a cross-sectional view of the unit cell 105, viewed along the line 1C-1C shown in FIG. 1B. It will be understood that the proportion of all elements in FIGS. 1B and 1C are not necessarily to scale, but may be enlarged or diminished for ease of viewing. With continued reference to FIG. 1B and reference to FIG. 1C, the unit cell 105 can include a resonance membrane 120 positioned within, and positioned laterally across, the transmissive acoustic channel 110. As such, the resonance membrane 120 is configured to vibrate in response to incident acoustic waves, and has an intrinsic resonance frequency, $F_{R1}$, determined substantially by the size of, and tension in, the resonance membrane 120. Thus, in certain implementations, the resonance membrane 120 can vibrate at the intrinsic resonance frequency, $F_{R1}$, and not at other frequencies.

The resonance membrane can be formed of a thin layer of elastic material, such as a polymeric resin including various synthetic thermoplastics, latex, and any other suitable material. The resonance membrane 120 can have a thickness of from around a few tens of micrometers to several hundred micrometers.

It will be understood that when a simple acoustic wave, having a single frequency component, $F_A$, that is substantially different from the inherent resonance frequency of the resonance membrane 120, enters the transmissive acoustic channel, the unit cell 105 will act substantially as a reflector. This is because the resonance membrane is unable to vibrate at the frequency $F_A$, and thus cannot transmit the wave.

However, when a simple acoustic wave, having a single frequency component, $F_B$, that is close to the inherent resonance frequency of the resonance membrane 120 ($F_B \approx F_{R1}$), the resonance membrane 120 will vibrate, thereby transmitting the wave.

Similarly, it will be understood that when a complex acoustic wave having multiple frequency components, e.g. $F_A$, $F_B$, and $F_C$, where $F_A \ll F_{R1}$; $F_B$ $F_{R1}$, and $F_C \gg F_{R1}$, because the resonance membrane 120 only vibrates at the intrinsic resonance frequency, $F_{R1}$, waves of frequency $F_B$ will be transmitted while $F_A$ and $F_C$ will be reflected. In this way, the acoustic metamaterial 100 can operate as a frequency selective acoustic transmitter.

The unit cell can further include at least one rigid structure 130 positioned within the transmissive acoustic channel 110. The at least one rigid structure 130 can occupy a linear or planar space parallel to, and separated by a constraint distance, $z_{crt}$, from the resonance membrane 120. In various implementations, and depending on the overall dimensions of the unit cell 105, the constraint distance can be within a range of from about 500 nm to about 5 μm. In many implementations, the constraint distance can be within a range of from about 0.75 μm to about 1.5 μm.

The unit cell 105 of FIGS. 1B and 1C includes two rigid structures 130, each having an "×" shape formed by two perpendicular bars. The constraint distance, $z_{crt}$, between the resonance membrane 120 and the at least one rigid structure 130 will generally be less than a maximum vibrational amplitude of the resonance membrane, the maximum vibrational amplitude corresponding to the maximum amplitude of vibration the resonance membrane can withstand without rupturing.

While the two rigid structures 130 of FIGS. 1B and 1C form an "×" shape as noted above, the shape of the at least one rigid structure 130 is not so limited. In many implementations, the at least one rigid structure 130 can have a shape that symmetrically divides the lateral (x,y), planar space occupied by the at least one rigid structure 130. For example, a single rod or bar across the center of the lateral, planar space occupied by the at least one rigid structure bisects the space, the "×" shaped structure of FIGS. 1B and 1C quadrisects the space, and other structures could trisect, pentasect, or otherwise symmetrically divide the lateral planar space occupied by the at least on rigid structure 130.

In instances in which there are two rigid structures 130, they will generally be spaced from the resonance membrane by the same constraint distance, and can have the same structure as one another. Thus, first and second rigid structures 130 will generally be longitudinally spaced in opposite directions from the resonance membrane 120 by the constraint distance. Thus, in many implementations in which there are two rigid structures 130, the two rigid structures 130 can have translational symmetry across the plane defined by the resonance membrane 120, as is the case in the exemplary unit cell 105 of FIGS. 1B and 1C. In other implementations, the two rigid structures 130 can have the same structure and same constraint distance, but can be rotated relative to one another within their respective lateral, planar spaces. It should also be understood that the at least one rigid structure need not be strictly planar.

The at least one rigid structure 130 will preferably have a low fill factor within its lateral, planar space, so that it does not substantially directly impede the propagation of acoustic waves through the acoustic channel 110. In certain implementations, such a lateral fill factor of the at least one rigid structure 130 can be less than 0.2, or less than 0.1, or less than 0.05, or less than 0.01.

Thus, the at least one rigid structure is positioned so that it can contact the resonance membrane 120 during vibration of the latter, specifically when the vibrational amplitude of the resonance membrane 120 is sufficient to match or exceed the constraint distance, $z_{crt}$, between the resonance membrane 120 and the at least one rigid structure 130. Stated alternatively, and with specific reference to FIG. 1C, the resonance membrane will vibrate with a maximum longitudinal displacement Δz that is proportional in magnitude to the pressure differential of the resonant incident acoustic wave having frequency, $F_{R1}$. When the incident resonant wave has high enough pressure differential to induce a maximum longitudinal displacement of the resonance membrane such that Δz equals $z_{crt}$, the resonance membrane 120 will contact the rigid structure 130 during vibration. Such contact can interfere with vibration of the resonance membrane 120, effectively changing its resonance frequency from the intrinsic resonance frequency, $F_{R1}$, to a second resonance frequency, $F_{R2}$. In general, the second resonance frequency will be greater than the intrinsic resonance frequency ($F_{R2} > F_{R1}$).

Configurations as described above therefore create a scenario in which metamaterials of the present teachings will selectively transmit acoustic waves of a specific frequency ($F_{R1}$), reflecting other frequencies, but only when the acoustic waves of the specific frequency are below a threshold pressure differential. As discussed above, the specific frequency is the inherent resonance frequency of the resonance membrane 120, and the threshold pressure differential is determined by the constraint distance, $z_{crt}$, between the resonance membrane 120 and the at least one rigid structure 130. When an acoustic wave at the same frequency ($F_{R1}$) exceeds the threshold pressure differential, a metamaterial of the present teachings will reflect it.

Thus, in the case of audible sound waves, an acoustic metamaterial 100 of the present teachings can be configured to transmit sound of a given frequency when it is relatively quiet, and to reflect sound of the same frequency when it is relatively loud. In general, such an acoustic metamaterial 100 which transmits or reflects acoustic waves of a specific frequency based solely upon the pressure differential of the acoustic wave can be referred to as an acoustic metamaterial 100 having passive control. Such exchange between frequency-specific transmission and reflection states is referred to herein as "passive control." It will be understood that a resonance membrane 120 can have multiple vibrational modes with different intrinsic resonance frequencies (e.g. $F_{R1'}$, $F_{R1''}$, etc.). Regardless of this, the passive control system will effectively reflect high pressure waves at resonance frequencies, when the physical interaction between the resonance membrane and the rigid structure 130 imposes a substantial physical constraint on the resonance membrane 120 when in the reflection state (e.g. when $z_{crt}$ equals Δz equals). This is equally true with respect to an acoustic metamaterial 100 having active transmission control, discussed further below.

Figure 2:
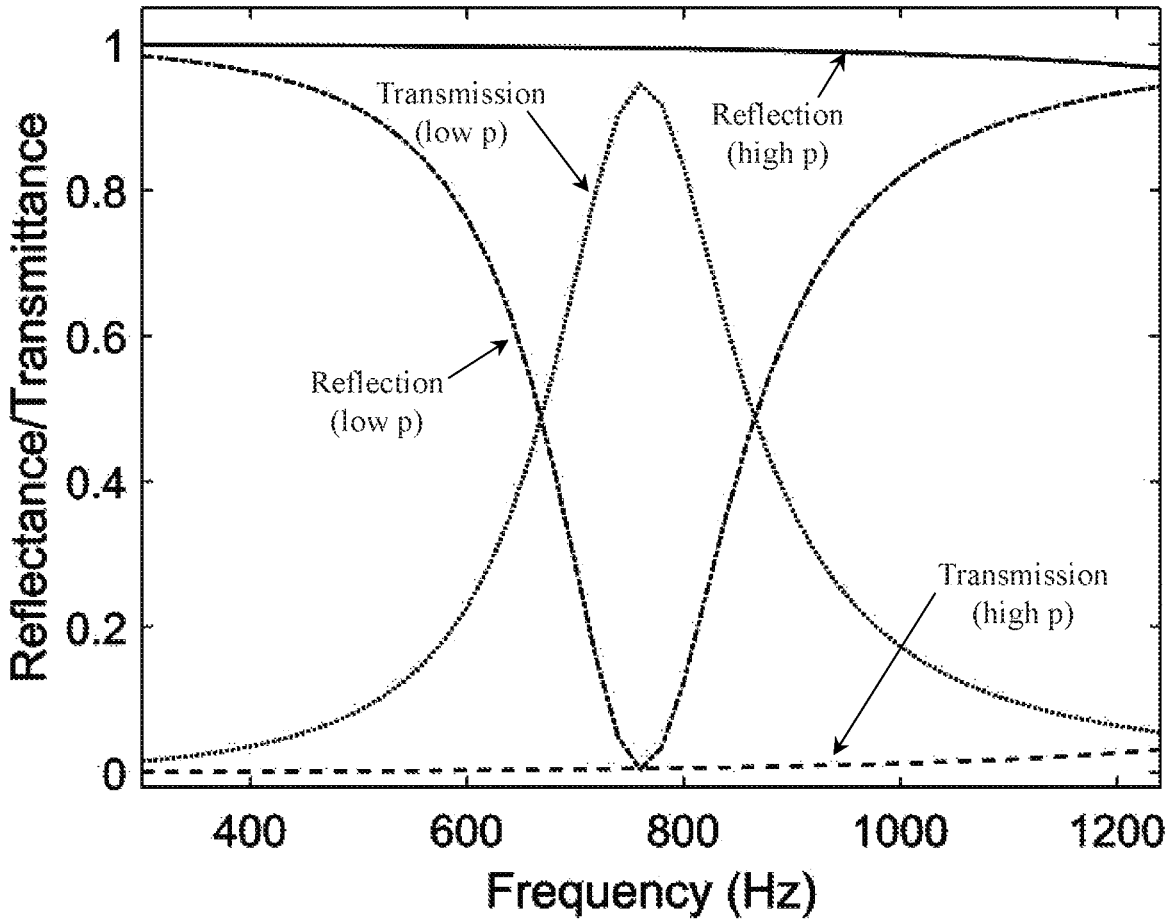
FIG. 2 is a graph of transmittance and reflectance as a function of wavelength for an acoustic metamaterial of the type shown in FIG. 1A, in response to high pressure and low pressure acoustic waves.

FIG. 2 shows calculated transmittance and reflectance data for such a metamaterial having passive control, in response to varying frequency. In FIG. 2, "low p" refers to an acoustic wave having a relatively low pressure differential that is below the pressure differential threshold, and "high p" refers to an acoustic wave having a relatively high pressure differential that is above the pressure differential threshold. The data in FIG. 2 are derived for a metamaterial having an intrinsic resonance frequency ($F_{R1}$) of about 780 Hz, corresponding approximately to a sixth octave A note on a piano keyboard. The constraint distance ($z_{crt}$) is 500 nm, the pressure differential of the "high p" wave is 0.5 Pa (corresponding to about 50 decibels), and the pressure differential of the "low p" wave is 0.2 Pa. As can be seen from the data in FIG. 2, when the incident acoustic wave is at relatively low pressure differential (relatively low volume), frequencies near 780 Hz are transmitted, with efficiency having an approximately Gaussian distribution centered at 780 Hz. The "low p" reflection curve is the inverse, with waves increasingly reflected as their frequency differs from 780 Hz. The "high p" transmission and reflection curves show that the resonance at 780 Hz has been impaired, such that the metamaterial is highly reflective across the entire frequency range examined.

Figure 3A:
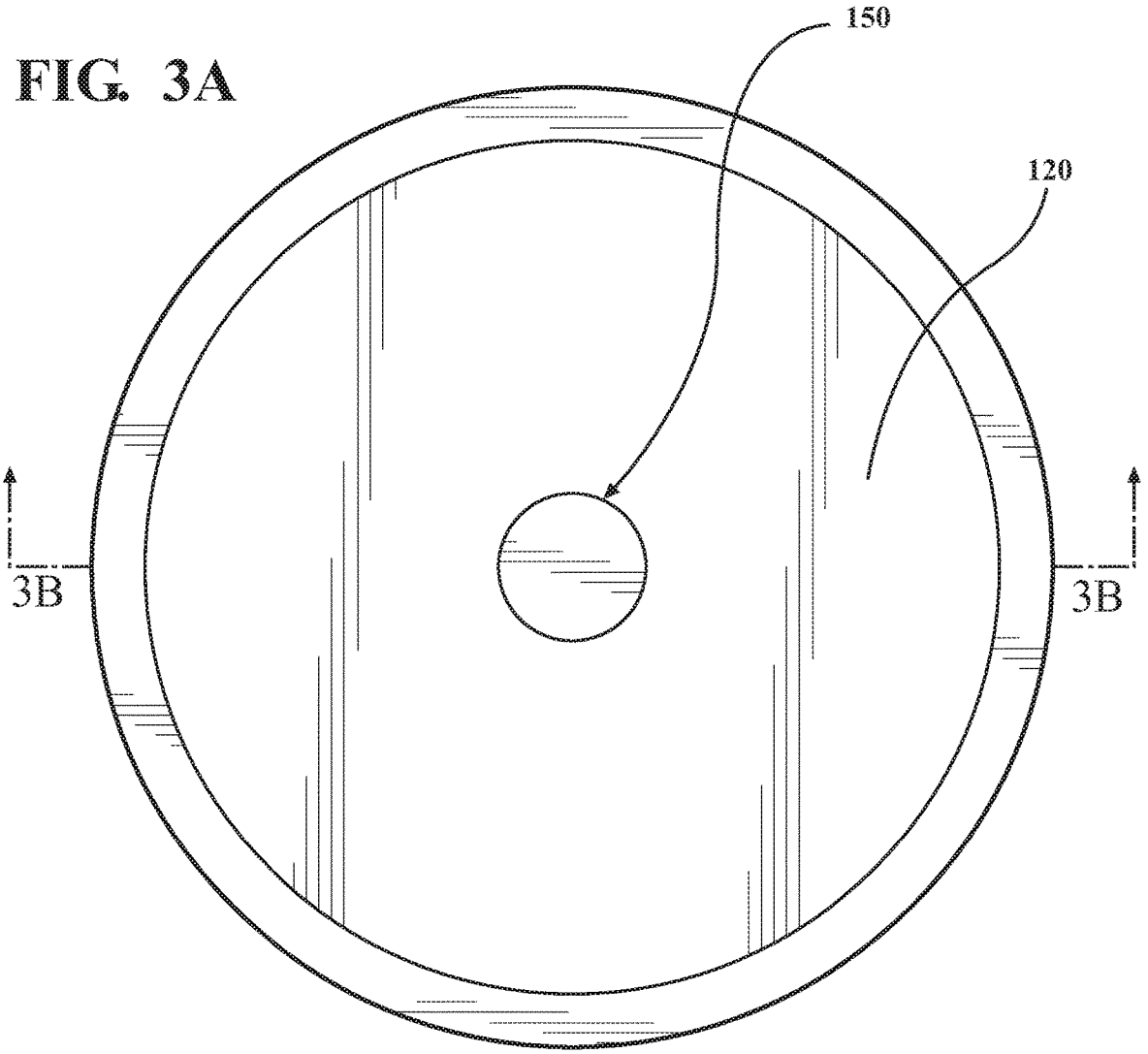
FIG. 3A is a top plan view of a unit cell of an acoustic metamaterial having active acoustic transmission control.
Figure 3B:
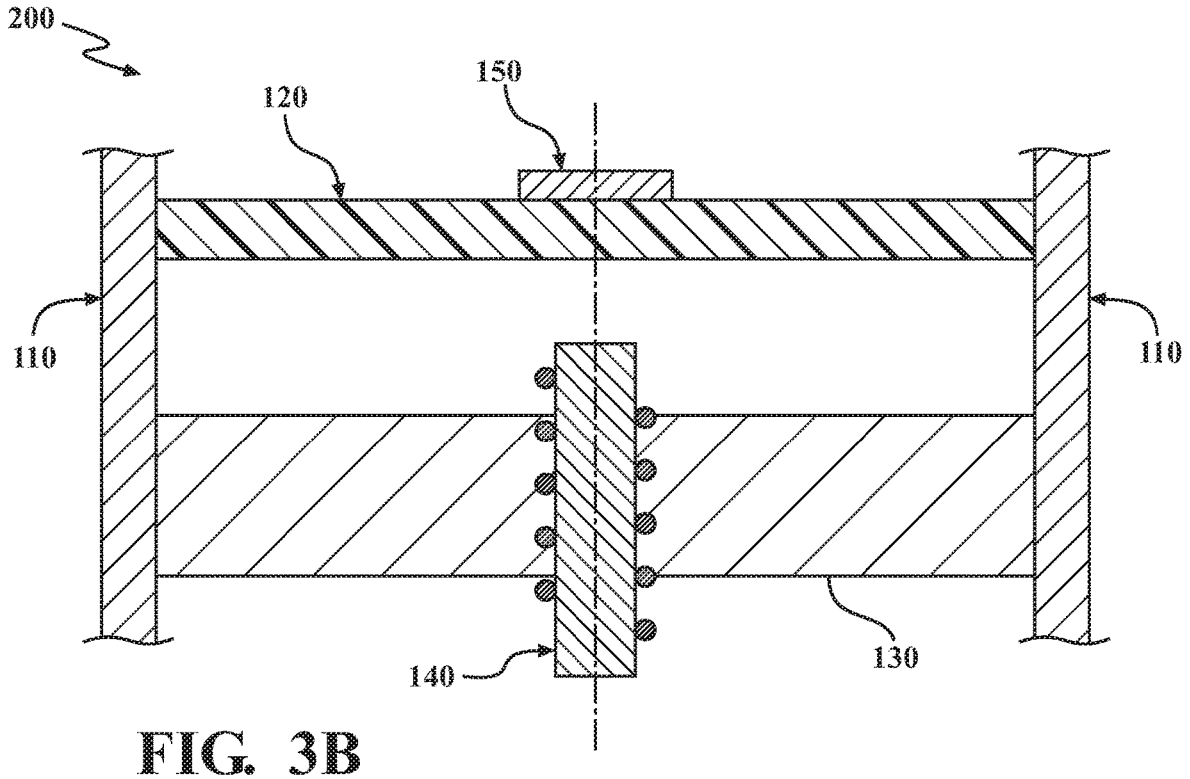
FIG. 3B is a side cross-sectional view of the unit cell of FIG. 3A, viewed along the line 3B-3B, and in an unactivated state.
Figure 3C:
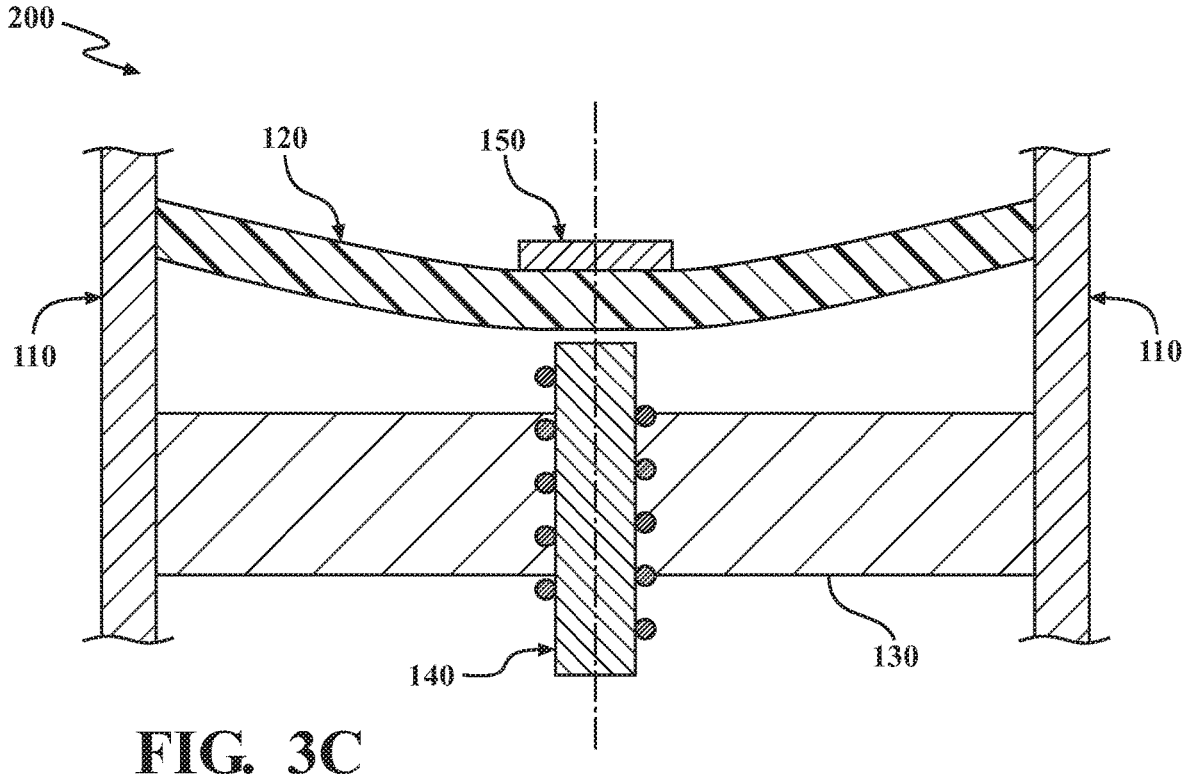
FIG. 3C is a side cross-sectional view of the unit cell of FIG. 3A in an activated state.

In certain implementations, an acoustic metamaterial 100 of the present teachings can include an active control system, operative to toggle transmission or reflection of a selected frequency on the basis of application of an electronic signal. FIG. 3A shows a top plan view of an exemplary unit cell 200 of such an acoustic metamaterial. FIGS. 3B and 3C show side cross-sectional views, each along the line 3B-3B of FIG. 3A. The unit cell 200 of FIG. 3B is in an unactivated state, while that of FIG. 3C is in an activated state. The actively controlled unit cell 200 of FIGS. 3A-3C includes an electromagnetic 140 and a ferromagnetic material 150 affixed to the resonance membrane 120. The electromagnet 140 is positioned a longitudinal distance (in the z-dimension in FIGS. 3B and 3C) from the resonance membrane 120 and, in conjunction with the ferromagnetic material 150, is configured to bias the resonance membrane 120, thereby changing its inherent resonance frequency, $F_{R1}$. In many implementations, the longitudinal distance of separation between the electromagnet 140 and the resonance membrane 120 can have any of the same attributes as the constraint distance, $z_{crt}$, described with respect to the rigid structure 130, above.

The ferromagnetic material 150 can be affixed to a surface of the resonance membrane 120. As shown particularly in the view of FIG. 3A, the ferromagnetic material 150 can specifically be affixed at and around the center of the resonance membrane 120. In some such implementations, the ferromagnetic material 150 can cover less than 50%, or less than 40%, or less than 30%, or less than 20%, or less than 10% of the area of the surface of the resonance membrane 120 to which it is affixed. In various implementations, the ferromagnetic material can include iron or an iron-containing alloy, a ferromagnetic ceramic such as ferrite or magnetite, or any other material that will have a tendency toward displacement when positioned in a magnetic field.

In the unactivated state, the electromagnet 140 does not receive current and therefore does not produce a magnetic field. In this state, the ferromagnetic material 150, and therefore the resonance membrane 120, is unaffected by the electromagnet 140. The resonance membrane thus possesses its inherent resonance frequency, $F_{R1}$ when the unit cell 200 is in the unactivated state. It will be noted that in the case of the actively controlled unit cell 200, $F_{R1}$ is altered by the mass of the ferromagnetic material 150, which can be accounted for during design.

In the activated state, the electromagnet 140 receives current and therefore produces a magnetic field tending to displace the ferromagnetic material 150. Because the ferromagnetic layer is affixed to the resonance membrane 120, this biases or displaces the resonance membrane, as shown in FIG. 3C. This displacement changes the resonance frequency of the resonance membrane 120 to a second resonance frequency, $F_{R2}$. In some implementations, the electromagnet 140 can be embedded in a rigid structure 130 of the type described above, as shown in FIGS. 3B and 3C. In some such implementations, the electromagnet 140 can longitudinally displace the resonance membrane by a distance that is less than $z_{crt}$, thereby changing the resonance frequency of the resonance membrane solely through addition of tension to the resonance membrane 120. In other implementations, the electromagnet 140 can, upon activation, cause the resonance membrane 120 to directly or indirectly contact the rigid structure 130 and/or the electromagnet 140. Indirect contact would be mediated by an intervening solid material. In such implementations, activation of the electromagnet 140, by contacting a central portion of the resonance membrane 120 against a solid structure, statically fixes a central portion of the resonance membrane 120 and causes the greatest differential in resonance frequency ($F_{R2} >> F_{R1}$).

Figure 4:
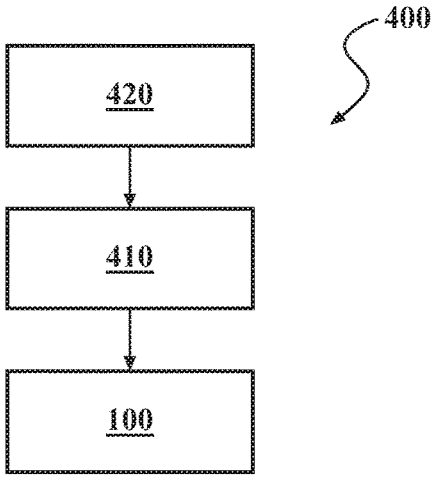
FIG. 4 is a block diagram of a system for toggling transmission of acoustic waves having a selected frequency.

It will thus be understood that a metamaterial having active transmission control can be toggled between a state in which acoustic waves having frequency $F_{R1}$, regardless of pressure differential, are transmitted or reflected, on the basis of whether electric current is supplied to the electromagnet 140. In various implementations, a controller can supply current to the electromagnet, thereby reflecting acoustic waves having frequency $F_{R1}$, in response to a user input; or in response to an algorithm, inputs of various sensors, etc. FIG. 4 is a block diagram of a disclosed system 400 for toggling transmission of acoustic waves having a selected frequency. The system 400 can include an acoustic metamaterial 100 of the type described above, having active control mediated by an electromagnet 140 positioned a longitudinal distance from a resonance membrane 120 and a ferromagnetic material 150 affixed to a surface of the resonance membrane 120 in each unit cell 200 of the metamaterial 100. In some implementations, the acoustic metamaterial 100 can be mounted on a substrate, such as a mesh or screen, that holds the unit cells 200 in a periodic array of the type illustrated in FIG. 1A, such that the open ends of the acoustic channels 110 are accessible to ambient air.

Each electromagnet 140 in the acoustic metamaterial 100 can be in signal communication with a controller 410 that is configured to situationally supply current to electromagnetics 140 in the metamaterial, thereby reversibly switching the acoustic metamaterial 100 from a state in which it substantially transmits acoustic waves having the selected frequency (i.e. a transmission state) to a state in which it substantially reflect acoustic waves having the selected frequency (i.e. a reflection state), according to the active control mechanism described above.

The controller 410 can further be in signal communication with an input device 420, configured to provide a signal directing the controller 410 to switch the acoustic metamaterial 100 from the transmission state to the reflection state, and vice-versa. In some implementations, the input device 420 can be a user input device, enabling a user to directly control the state (transmissive or reflective) of the acoustic metamaterial 100. In some implementations, the input device 420 can be a timer, directing the controller to switch the acoustic metamaterial 100 from the transmission state to the reflection state, and vice-versa at pre-determined intervals. In some implementations, the input device 420 can be an environmental sensor, such as a light sensor or another type, configured to direct the controller to switch the acoustic metamaterial 100 from the transmission state to the reflection state, and vice-versa in response to an environmental condition.

The preceding description is merely illustrative in nature and is in no way intended to limit the disclosure, its application, or uses. As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range.

The headings (such as "Background" and "Summary") and sub-headings used herein are intended only for general organization of topics within the present disclosure, and are not intended to limit the disclosure of the technology or any aspect thereof. The recitation of multiple embodiments having stated features is not intended to exclude other embodiments having additional features, or other embodiments incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should be also understood that the various method steps discussed herein do not have to be carried out in the same order as depicted, and not each method step is required in each aspect or embodiment.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations should not be regarded as a departure from the disclosure, and all such modifications are intended to be included within the scope of the disclosure.

What is claimed is:

1. An acoustic metamaterial having passive transmission control, the acoustic metamaterial comprising a periodic array of unit cells, each unit cell comprising:

a transmissive acoustic channel, having a structure with at least one side wall and two open ends to allow for passage of acoustic waves in a longitudinal direction;

a resonance membrane positioned laterally across the transmissive acoustic channel, and having an intrinsic resonance frequency, $F_{R1}$, such that the resonance membrane vibrates with a maximum longitudinal displacement, $\Delta z$, at the intrinsic resonance frequency, when contacted by an acoustic wave component defined by a frequency $\approx F_{R1}$ and having a pressure differential, where $\Delta z$ is proportional to the pressure differential to an upper limit; and at least one rigid structure positioned within the transmissive acoustic channel, occupying a planar space parallel to, and separated by a constraint distance, $z_{crt}$, from, the resonance membrane such that $z_{crt}$ defines an upper limit of $\Delta z$;

the unit cell substantially transmitting the acoustic wave component when $\Delta z < z_{crt}$, and substantially reflecting the acoustic wave component when $\Delta z = z_{crt}$.

2. The acoustic metamaterial as recited in claim 1, wherein the transmissive acoustic channel is cylindrical.

3. The acoustic metamaterial as recited in claim 1, wherein the constraint distance is less than a maximum vibrational amplitude the resonance membrane can withstand without rupturing.

4. The acoustic metamaterial as recited in claim 1, wherein $z_{crt}$ is within a range of from about 500 nm to about 5 μm.

5. The acoustic metamaterial as recited in claim 1, wherein $z_{crt}$ is within a range of from about 0.75 μm to about 1.5 μm.

6. The acoustic metamaterial as recited in claim 1, wherein the at least one rigid structure symmetrically divides the planar space.

7. The acoustic metamaterial as recited in claim 1, wherein the at least one rigid structure quadrisects the planar space.

8. The acoustic metamaterial as recited in claim 1, comprising first and second rigid structures coupled to the at least one side wall and longitudinally spaced in opposite directions from the resonance membrane by the constraint distance.

9. The acoustic metamaterial as recited in claim 8, wherein the first and second rigid structures have translation symmetry across a plane defined by the resonance membrane.

10. An acoustic metamaterial having active transmission control, the acoustic metamaterial comprising a periodic array of unit cells, each unit cell comprising:

a transmissive acoustic channel, having a structure with at least one side wall and two open ends to allow for passage of acoustic waves in a longitudinal direction;

a resonance membrane positioned laterally across the transmissive acoustic channel, and configured to vibrate at an intrinsic resonance frequency, $F_{R1}$, in response to an incident acoustic wave component having the intrinsic resonance frequency;

a ferromagnetic material affixed to a portion of a surface of the resonance membrane; and an electromagnet positioned a longitudinal distance from the resonance membrane and, when activated, configured to bias the resonance membrane, via magnetic interaction with the ferromagnetic material, thereby reversibly reconfiguring the resonance membrane to no longer vibrate at $F_{R1}$, and instead to vibrate at a second resonance frequency, $F_{R2}$, where $F_{R1} \neq F_{R2}$, each unit cell substantially transmitting an incident acoustic wave component defined by a frequency $\approx F_{R1}$ when the electromagnet is not activated; and each unit cell substantially reflecting the incident acoustic wave component when the electromagnet is activated.

11. The acoustic metamaterial as recited in claim 10, wherein the ferromagnetic material is affixed at and around the center of the resonance membrane, and covers less than 10% of an area of the surface of the resonance membrane to which it is affixed.

12. The acoustic metamaterial as recited in claim 10, wherein activation of the electromagnet brings a central portion of the resonance membrane into contact with a solid structure, thereby statically fixing the central portion of the resonance membrane.

13. The acoustic metamaterial as recited in claim 10, wherein the ferromagnetic material comprises at least one of: iron, and an iron-containing alloy.

14. The acoustic metamaterial as recited in claim 10, wherein each unit cell further comprises:

at least one rigid structure positioned within the transmissive acoustic channel, occupying a planar space parallel to, and separated by a constraint distance from, the resonance membrane.

15. A system for toggling transmission of acoustic waves having a selected frequency, the system comprising:

an acoustic metamaterial having active transmission control, the acoustic metamaterial comprising a periodic array of unit cells, each unit cell comprising:

a transmissive acoustic channel, having a structure with at least one side wall and two open ends to allow for passage of acoustic waves in a longitudinal direction;

a resonance membrane positioned laterally across the transmissive acoustic channel, and configured to vibrate at an intrinsic resonance frequency, $F_{R1}$, in response to an incident acoustic wave component defined by a frequency $\approx F_{R1}$;

a ferromagnetic material affixed to a portion of a surface of the resonance membrane; and an electromagnet positioned a longitudinal distance from the resonance membrane and, when activated, configured to bias the resonance membrane, via magnetic interaction with the ferromagnetic material, thereby reversibly reconfiguring the resonance membrane to no longer vibrate at $F_{R1}$;

a controller configured to reversibly supply current to the electromagnets, thereby reversibly switching the acoustic metamaterial from a transmission state to a reflection state; and an input device configured to provide a signal directing the controller to switch the acoustic metamaterial from the transmission state to the reflection state, or vice-versa, each unit cell substantially transmitting the incident acoustic wave component when the acoustic metamaterial is in the transmission state; and substantially reflecting the incident acoustic wave component when the acoustic metamaterial is in the reflection state.

16. The system as recited in claim 15, wherein the input device comprises a user input device enabling a user to directly control the state (transmissive or reflective) of the acoustic metamaterial.

17. The system as recited in claim 16, wherein the input device comprises a timer, directing the controller to switch the acoustic metamaterial from the transmission state to the reflection state, at pre-determined intervals.

18. The system as recited in claim 17, wherein the input device comprises an environmental sensor, configured to provide the signal to switch the acoustic metamaterial from the transmission state to the reflection state in response to an environmental condition.

* * * * *